US006176182B1

(12) United States Patent
Nakayama et al.

(10) Patent No.: US 6,176,182 B1
(45) Date of Patent: Jan. 23, 2001

(54) BLOCK COPY MATERIAL FOR LITHOGRAPHIC PRINTING PLATE MATERIAL, LITHOGRAPHIC PRESS AND LITHOGRAPHIC PRINTING METHOD

(75) Inventors: Takao Nakayama; Hidefumi Sera; Mutsumi Naniwa, all of Shizuoka (JP)

(73) Assignee: Fuji Photo Film Co., Ltd., Ashigara (JP)

( * ) Notice: Under 35 U.S.C. 154(b), the term of this patent shall be extended for 0 days.

(21) Appl. No.: 09/131,700

(22) Filed: Aug. 10, 1998

(30) Foreign Application Priority Data

Aug. 12, 1997 (JP) ..... 9-230411
Sep. 25, 1997 (JP) ..... 9-278133

(51) Int. Cl.[7] ..... B41N 6/00
(52) U.S. Cl. ..... 101/375; 101/382.1
(58) Field of Search ..... 101/141, 217, 101/375, 376, 382.1, 389.1, 401, 401.1, 401.3, 415.1, 453; 492/18, 30, 37

(56) References Cited

U.S. PATENT DOCUMENTS

| | | | | |
|---|---|---|---|---|
| 4,643,093 | * | 2/1987 | Goar et al. | 101/401.1 |
| 4,643,095 | * | 2/1987 | Pfizenmaier et al. | 101/375 |
| 4,676,161 | * | 6/1987 | Peekna | 101/378 |
| 4,766,811 | * | 8/1988 | Linska | 101/382.1 |
| 5,511,476 | * | 4/1996 | Banike et al. | 101/375 |
| 5,601,020 | * | 2/1997 | Dawley et al. | 101/375 |
| 5,673,623 | * | 10/1997 | Schmid | 101/415.1 |
| 5,775,225 | | 7/1998 | Saitou | 101/415.1 |
| 5,797,827 | * | 8/1998 | Sondergeld | 492/37 |

FOREIGN PATENT DOCUMENTS

| | | |
|---|---|---|
| 3525045 | 1/1987 | (DE) . |
| 246012 | 11/1987 | (EP) . |
| 63-109090 | 5/1988 | (JP) . |
| 7-425 | 1/1995 | (JP) . |

OTHER PUBLICATIONS

Patent Abstracts of Japan, vol. 017, No. 639 (M–1515), Nov. 26, 1993 & JP 05200970 A (Mitsubishi Heavy Ind. Ltd.), Aug. 10, 1993 *abstract*.

Patent Abstracts of Japan, vol. 017, No. 106 (M–1375), Mar. 4, 1993 & JP 04296557 A (Mitsubishi Heavy Ind. Ltd.), Oct. 20, 1992 *abstract*.

Patent Abstracts of Japan, vol. 006, No. 263 (M–181), Dec. 22, 1982 & JP 57156296 A (Touyou Cloth KK), Sep. 27, 1982 *abstract*.

* cited by examiner

*Primary Examiner*—Stephen R. Funk
(74) *Attorney, Agent, or Firm*—Burns, Doane, Swecker & Mathis, LLP

(57) ABSTRACT

A block copy material for a lithographic printing plate material comprising a sheet-like substrate, on at least one side of which a plurality of minute projections are distributively formed, or a lithographic press having a plate cylinder, on a surface of which a plurality of minute projections are distributively formed, wherein the density of minute projections having a height of more than 40 $\mu$m is 20 projections/cm$^2$ or less on surface average, and the density of minute projections having a height of 3 $\mu$m or more is 25 projections/cm$^2$ or more on surface average. The block copy material for a lithographic printing plate material, the lithographic press and a lithographic printing method using the block copy material or the lithographic press can avoid the deterioration of the printing dimension and printing accuracy caused by strain partially developed in printing, and can solve the problem of conventional methods, the deterioration of the workability in printing.

8 Claims, No Drawings

BLOCK COPY MATERIAL FOR LITHOGRAPHIC PRINTING PLATE MATERIAL, LITHOGRAPHIC PRESS AND LITHOGRAPHIC PRINTING METHOD

FIELD OF THE INVENTION

The present invention relates to a block copy material for a lithographic printing plate material, a lithographic press and a lithographic printing method.

BACKGROUND OF THE INVENTION

Generally, in printing machines for lithography, printing plates are wrapped around plate cylinders and mechanically fixed thereto, and in this state, printing is carried out.

However, lithographic printing plates using materials other than easily treatable metals (for example, plastic films and paper) as substrates have a disadvantage in dimensional stability. For example, they have the problem that the plates are partially strained by the friction between blanket cylinders and the plates, resulting in deterioration of the printing dimension and printing accuracy.

In the case of the plates in which the substrates as described are used, therefore, the use thereof has hitherto been limited to easy methods in which the register accuracy of printed matter is not required and a small number of sheets are printed, and they have not been used as such in high-grade multicolor accurate printing and full-scale printing using large-sized printing machines.

In order to solve such a problem, JP-A-63-109090 proposes a method of directly adhering a plate material to a plate cylinder or a block copy plate for adjusting touch pressure between a printing plate and a blanket cylinder by use of, for example, an acrylic or rubber adhesive double coated sheet or spray adhesive.

In such a method, however, the problem newly arises that fine adjustment of the position of the printing plate on the plate cylinder is impossible, or that the workability of plate discharge and the like after printing is extremely deteriorated, because the printing plate is firmly adhered to the plate cylinder.

Further, JP-B-7-425 proposes a method of providing a plate cylinder of a printing machine with a specified silicone rubber film to improve the printing accuracy.

According to this method, however, the silicone rubber film is not separated from the printing machine, so that, for example, it is difficult to simply remove it as the conventional block copy materials for the adjustment, and when printing plates different in thickness are used in the same printing machine, it becomes necessary to replace a block copy material for the adjustment to the plate thickness thereof. This method therefore has the problem that the workability of this replacement is extremely deteriorated.

SUMMARY OF THE INVENTION

An object of the present invention is to provide a block copy material for a lithographic printing plate material, a lithographic press and a lithographic printing method which can avoid the deterioration of the printing dimension and printing accuracy caused by strain partially developed in printing, and can solve the problem of the above-mentioned conventional methods, the deterioration of the workability in printing.

Such an object can be attained by any one of the following (1) to (4):

(1) A block copy material for a lithographic printing plate material comprising a sheet-like substrate, on at least one side of which a plurality of minute projections are distributively formed, wherein the density of minute projections having a height of more than 40 $\mu$m is 20 projections/cm$^2$ or less on surface average, and the density of minute projections having a height of 3 $\mu$m or more is 25 projections/cm$^2$ or more on surface average;

(2) A lithographic printing method comprising carrying out printing by using a plate cylinder provided with the block copy material for the lithographic printing plate material of the above (1) so that the side on which the minute projections are formed face toward the lithographic printing plate material side;

(3) A lithographic press having a plate cylinder, wherein said plate cylinder has a surface on which a plurality of minute projections are formed, the density of projections having a height of more than 40 $\mu$m is 20 projections/cm$^2$ or less on surface average, and the density of minute projections having a height of 3 $\mu$m or more is 25 projections/cm$^2$ or more on surface average; and (4) A lithographic printing method comprising carrying out printing by using the plate cylinder for lithography of the above (3) around which a lithographic printing plate is wrapped.

DETAILED DESCRIPTION OF THE INVENTION

In the present invention, using the block copy material for the lithographic printing plate material on at least one side of which the plurality of minute projections are formed or the plate cylinder for lithography having the surface on which the plurality of minute projections are formed, the frictional resistance with the lithographic printing plate material opposes the force applied to the lithographic printing plate material in printing to suppress the strain (elongation) caused by this force. Moreover, in the block copy material for the lithographic printing plate material or the plate cylinder, the strain of the lithographic printing plate material is not suppressed by the conventional adhesive force, so that the printing plate material is easily removed.

Accordingly, the block copy material for the lithographic printing plate material and the plate cylinder of the present invention prevents the strain of the printing plate with no sacrifice in workability.

Specific constitution of the present invention is described below in detail.

When the block copy material having the constitution of the above (1) is used, the printing machine which can be used in the present invention may be any, as long as it comprises at least an ink supply device for forming an ink film having a definite thickness on a surface of a form roller, a plate cylinder fitted with a printing plate by fixing a head portion of a printing plate comprising an image area receiving ink and a nonimage area to which no ink is adhered, and by forcedly pulling an edge portion of the plate as required, and an impression cylinder for urging a material to be printed toward the above-mentioned plate cylinder to perform printing. An example thereof is an offset printing press in which a blanket cylinder which is pressed on the above-mentioned plate cylinder to transfer an image and urges the image toward the material to be printed to conduct printing is attached between the above-mentioned plate cylinder and impression cylinder of the printing machine.

Then, the block copy material for prevention of the strain (elongation) of the lithographic printing plate in the present invention is described.

The block copy material of the invention (1) is a sheet-like member having an area approximately similar to that of the lithographic printing plate material, and the plurality of minute projections are distributively formed on at least one side thereof. The height of the minute projections is preferably 1 to 50 $\mu$m. The density of projections having a height of more than 40 $\mu$m is preferably 20 projections/cm$^2$ or less on surface average, and particularly preferably 0, and the density of projections having a height of 3 $\mu$m or more is preferably 25 projections/cm$^2$ or more, and particularly preferably 400 projections/cm$^2$ or more. When the distribution of minute projections is within the above-mentioned range, the force for suppressing the strain of the lithographic printing plate material in printing effectively acts. Although there is no particular upper limit to the number of the distributed minute projections having a height of 3 $\mu$m or more, it is considered to be about 10,000 projections/cm$^2$.

The shape of the above-mentioned minute projections is not particularly required, but they are usually in rod or needle form.

According to one method for forming the minute projections of the present invention, minute particles are dispersed in a binder to prepare a dispersion, which is applied onto a surface of the sheet-like substrate and dried.

The average particle size of the minute particles used is preferably about 2 to about 50 $\mu$m.

The above-mentioned minute particles may be either organic materials or inorganic materials. However, the mechanical strength of the minute projections is required, so that inorganic materials are preferred. The inorganic materials include diamond, emery, spinel, garnet, flint, alumina (melt), silicon carbide, boron carbide, other carbides, clay, talc, microcrystalline silicic acid, iron (III) oxide, chromium (III) oxide, alumina (sintered product), quartzite, other rocks in which fine particles of high-hardness minerals combine and synthetic composite crystals.

Such materials are finely divided so as to meet the above-mentioned conditions to form minute particles.

As the above-mentioned binders, silicone resins, polystyrene, polyacrylic or polymethacrylic esters, polyvinyl acetate, polyvinyl chloride, polyvinyl butyral and derivatives thereof are used.

It is preferred that this binder contains about 5% to about 80% by weight of the above-mentioned minute particles.

The substrate used in the block copy material may be any, as long as it is good in fitness for the plate cylinder of the printing machine, such as a plastic such as polyethylene terephthalate, polypropylene or polyethylene, a metal such as aluminum or SUS (stainless steel), paper, synthetic paper or cloth. Polyethylene terephthalate excellent in dimensional stability and having rigidity is preferred. An adhesive material may be attached to the side opposite to an uneven face of the block copy material in contact with the plate cylinder of the printing machine.

The film thickness of the block copy material is 0.03 mm to 0.6 mm, and preferably 0.05 mm to 0.3 mm. Within this range, the handling in the large size and the fitness for the plate cylinder of the printing machine are satisfactory, and further, the workability such as adjustment of the printing machine is not deteriorated.

The substrate may be coated with the minute particle-dispersed coating solution by any methods, as long as the coating solution can be uniformly applied and the minute particles are dispersed as uniformly as possible. Examples of such methods include coating with a roll coater, a spray gun or a bar coater. The film thickness of only a binder layer thus obtained is preferably 0.1 $\mu$m to 50 $\mu$m, and more preferably 0.3 $\mu$m to 10 $\mu$m. The minute particles are partially projected from a surface of the binder layer to form the minute projections.

In addition to this, (1) forcing of the minute particles into the binder by mechanical pressure after formation of the binder film, (2) formation of the minute projections by blast treatment to the block copy material, (3) formation of the minute projections by pressing the block copy material with a roll on which minute projections are formed, (4) thermal spraying, (5) discharge treatment, (6) laser treatment, (7) etching (applied to the metal block copy material), and (8) formation of the minute projections by photoresist coating→minute projection pattern exposure→development resist removal→etching are considered as methods for forming the minute projections on the block copy material of the invention (1).

The block copy material of the invention (1) can withstand its repeated use. However, dust adhered to the back of the plate material and components of a fountain solution sometimes adhere to the minute projection-formed side depending on the conditions to deteriorate the dimensional stability of the plate material. In such a case, washing with water or a petroleum solvent (Isopar E) can recover the performance to make it possible to repeatedly use the block copy material.

For the resistance to repeatability, cloth (made of cotton) impregnated with water or Isopar E is fixed to a specialized jig on the projection-formed side so as to give a contact area with a minute projection-formed layer of 0.5×0.5 mm$^2$, the contacted area is reciprocated in parallel on a surface property measuring instrument (HEIDON-14 type) at a load of 0.5 kg, and the repeatedly reciprocated cycles at the time when the minute projection-formed layer is dissolved or damaged are measured. When the reciprocated cycles are 50 cycles or more, the resistance to repeatability is good.

With respect to a method for mounting the block copy material of the invention (1), the block copy material is only put between the printing plate and the plate cylinder of the printing machine so that the minute projection-formed side faces toward the back of the printing plate, and the printing plate is fixed with a vise on plate cylinder, or at least one end of the block copy material is fixed to the plate cylinder together with the printing plate by means of a vise on plate cylinder. The adhesion between the block copy material and the plate cylinder of the printing machine may be increased by application of a spray glue or an adhesive therebetween. This can adhere the minute projection-formed side of the block copy material to the back of the printing plate, thereby suppressing the strain developed in printing the printing plate, for example, the strain of the plate induced by the friction between a blanket and the plate in printing. As a result, the printing dimension and accuracy can be maintained.

Then, the plate cylinder for prevention of the strain (elongation) of the lithographic printing plate in the invention (3) is described.

In the plate cylinder of the invention (3), the plurality of minute projections are distributively formed on the surface thereof. The height of the minute projections is preferably 1 to 50 $\mu$m. The density of projections having a height of more than 40 $\mu$m is preferably 20 projections/cm$^2$ or less on surface average, and particularly preferably 0, and the density of projections having a height of 3 $\mu$m or more is preferably 25 projections/cm$^2$ or more, and particularly preferably 400 projections/cm$^2$ or more. When the distribution of minute projections is within the above-mentioned range, the force for suppressing the strain of the lithographic printing plate in printing effectively acts. Although there is no particular upper limit to the number of the distributed minute projections having a height of 3 $\mu$m or more, it is considered to be about 10,000 projections/cm$^2$.

The shape of the above-mentioned minute projections is not particularly required, but they are usually in rod, pyramid or needle form.

Methods for forming the minute projections on the plate cylinder of the invention (3) include methods of forming the projections directly thereon such as (1) formation of the minute projections by blast treatment to the plate cylinder, (2) formation of the minute projections by pressing the plate cylinder with a roll on which minute projections are formed, (3) thermal spraying, (4) discharge treatment, (5) etching with a laser, (6) abrasion with an electron beam, (7) formation of the minute projections by photoresist coating→minute projection pattern exposure→development resist removal→etching, and (8) formation of the minute projections by directly applying a dispersion in which the minute particles are dispersed in a binder onto a surface of the plate cylinder and drying it, and methods of adhering a sheet having minute projections thereon to a metal surface of the plate cylinder.

The latter methods include (9) a method in which the minute particles are dispersed in a binder to prepare a dispersion, which is applied onto a surface of the sheet-like substrate and dried, and (10) a method in which the minute particles are forced into a binder by mechanical pressure after formation of a binder film. The above (8) is described herein as an example.

The average particle size of the minute particles used is preferably about 2 to about 50 $\mu$m.

The above-mentioned minute particles may be either organic materials or inorganic materials. However, the mechanical strength of the minute projections is required, so that inorganic materials are preferred. The inorganic materials include diamond, emery, spinel, garnet, flint, alumina (melt), silicon carbide, boron carbide, other carbides, clay, talc, microcrystalline silicic acid, iron (III) oxide, chromium (III) oxide, alumina (sintered product), quartzite, other rocks in which fine particles of high-hardness minerals combine and synthetic composite crystals.

Such materials are finely divided so as to meet the above-mentioned conditions to form minute particles.

As the above-mentioned binders, silicone resins, polystyrene, polyacrylic or polymethacrylic esters, polyvinyl acetate, polyvinyl chloride, polyvinyl butyral and derivatives thereof are used.

It is preferred that this binder contains about 5% to about 80% by weight of the above-mentioned minute particles.

The material of surface parts of the plate cylinders themselves used in the invention (3) is generally stainless steel plated with chromium, but all materials used in the plate cylinders of the printing machines are applied. The structure and material of the plate cylinders themselves may be the same as those of the conventional plate cylinders, so that further descriptions are omitted.

The surface of the plate cylinder may be coated with the minute particle-dispersed coating solution by any methods, as long as the coating solution can be uniformly applied and the minute particles are dispersed as uniformly as possible. Examples of such methods include coating with a roll coater, a spray gun or a bar coater. The film thickness of only a binder layer thus obtained is preferably 0.1 $\mu$m to 50 $\mu$m, and more preferably 0.3 $\mu$m to 10 $\mu$m. The minute particles are partially projected from a surface of the binder layer to form the minute projections.

Methods for mounting the printing plate on the plate cylinder of the present invention are the same as the usual methods. For example, the printing plate may only be fixed with a vise on plate cylinder. This can adhere the minute projection-formed side of the plate cylinder to the back of the printing plate, thereby suppressing the strain developed in printing the printing plate, for example, the strain of the plate induced by the friction between a blanket and the plate in printing. As a result, the printing dimension and accuracy can be maintained.

The plate cylinder of the invention (3) can withstand repeated use. However, dust adhered to the back of the plate material and components of a fountain solution sometimes adhere to the minute projection-formed side depending on the conditions to deteriorate the dimensional stability of the plate material. In such a case, washing with water or an organic solvent can recover the performance to make it possible to repeatedly use the plate cylinder.

For the resistance to repeatability, cloth (made of cotton) impregnated with water or an ink washing solution (Daiclean R supplied from Dainippon Ink & Chemicals, Inc.) is fixed to a specialized jig on the projection-formed side so as to give a contact area with a minute projection-formed layer of 0.5×0.5 mm$^2$, the contacted area is reciprocated in parallel on a surface property measuring instrument (HEIDON-14 type) at a load of 0.5 kg, and the repeatedly reciprocated cycles at the time when the minute projection-formed layer is dissolved or damaged are measured. When the reciprocated cycles are 50 cycles or more, the resistance to repeatability is good.

EXAMPLES

The present invention will be further illustrated in greater detail with reference to the following examples.

Example 1

A 100-$\mu$m thick Lumilar film manufactured by Toray Industries, Inc., which is used as a substrate, was coated with a dispersion obtained by dispersing each of the following inorganic particles of five kinds in an amount shown Table 1 and an acrylic resin (manufactured by Fuji Photo Film Co., Ltd., Tg=37° C., a 40% toluene solution) as a binder in toluene with an EXCEL AUTO HOMOGENIZER (manufactured by Nippon Seiki Co., Ltd.) at 12,000 rpm for 15 minutes, by use of a wire bar so as to give a dry amount coated of 10 g/m$^2$, and then dried to obtain a sample of a block copy material. For coated surfaces of the series of samples, the height and density of projections were measured using a three-dimensional surface roughness tester (a measuring instrument Model SE-3F1, PU-DJ2U, and an analyzer Model SPA-11) manufactured by Kosaka Laboratory Ltd.

The following inorganic particles of five kinds were used:

FO #500, FO #1200, FO #3000, A #320 and A #240 (all manufactured by Fujimi Incorporated).

The composition and particle size at an accumulated height of 94% of the above-mentioned respective inorganic particles are shown in Table 2. Further, the term "particle size at an accumulated height of 94%" as used herein means a particle size of the inorganic particles at 94% by number of the particle size distribution accumulated from the maximum particle size.

The formulation of the coating materials prepared and the density of projections on the resulting surfaces by height of the projections are shown in Table 1.

TABLE 1

| Sample No. | Formulation (g) Inorganic Particle | Amount Used | Resin Solution | Toluene | Density of Projections Having the Following Height (projections/cm$^2$) <3 μm | 3–5 μm | 5–15 μm | 15–40 μm | 40 μm< |
|---|---|---|---|---|---|---|---|---|---|
| 1 | A #240 | 20 | 5 | 10 | Unknown | Unknown | Unknown | 3410 | 54 |
| 2 | A #240 | 20 | 10 | 20 | Unknown | Unknown | Unknown | 1320 | 24 |
| 3 | A #240 | 6 | 20 | 30 | Unknown | Unknown | Unknown | 889 | 11 |
| 4 | A #320 | 20 | 5 | 10 | Unknown | Unknown | Unknown | 975 | 2 |
| 5 | A #320 | 12 | 10 | 20 | Unknown | Unknown | Unknown | 325 | 0 |
| 6 | A #320 | 6 | 20 | 30 | Unknown | Unknown | Unknown | 106 | 0 |
| 7 | FO #500 | 20 | 5 | 10 | Unknown | Unknown | 2310 | 73 | 0 |
| 8 | FO #500 | 12 | 10 | 20 | Unknown | Unknown | 870 | 24 | 0 |
| 9 | FO #500 | 6 | 20 | 30 | Unknown | Unknown | 392 | 11 | 0 |
| 10 | FO #1200 | 20 | 5 | 10 | ∞ | 1485 | 93 | 5 | 0 |
| 11 | FO #1200 | 12 | 10 | 20 | ∞ | 777 | 45 | 0 | 0 |
| 12 | FO #1200 | 6 | 20 | 30 | ∞ | 402 | 18 | 0 | 0 |
| 13 | FO #3000 | 20 | 5 | 10 | ∞ | 85 | 2 | 0 | 0 |
| 14 | FO #3000 | 12 | 10 | 20 | ∞ | 27 | 1 | 0 | 0 |
| 15 | FO #3000 | 6 | 20 | 30 | ∞ | 2 | 0 | 0 | 0 |
| 16 | Not coated | | | | | | None | | |

"Unknown" means that particles are concealed by larger particles to give no clear values, and "∞" means 5000 projections or more.

TABLE 2

| | Composition (% by weight) $Al_2O_3$ | $SiO_2$ | $Fe_2O_3$ | $TiO_2$ | $ZrO_2$ | Particle Size at An Accumulated Height of 94% |
|---|---|---|---|---|---|---|
| FO #500 | 47.5 | 18.5 | 0.4 | 1.4 | 37.5 | 12.5 |
| FO #1200 | 48.3 | 17.9 | 0.4 | 1.5 | 31.9 | 5.1 |
| FO #3000 | 43.2 | 20.3 | 0.5 | 1.5 | 34.5 | 1.8 |
| A #320 | 91.3 | 4.2 | 0.7 | 3.8 | — | 28.5 |
| A #240 | 91.8 | 4.4 | 0.6 | 3.2 | — | 47.5 |

The elongation of the printing plate in printing was measured using an Oliver 52 printing machine manufactured by Sakurai Kikai Hanbai Co., Ltd. under the standard printing conditions. As the printing plate, an ELP-2X master prepared with an ELP-580 platemaking machine manufactured by Fuji Photo Film Co., Ltd. was used. In the printing machine, the thickness of a sample layer including the printing plate on the plate cylinder was adjusted to 500 μm. According to this, the 100-μm block copy material for prevention of plate elongation prepared herein and further a 200-μm film for thickness adjustment were set in this order under the 200-μm ELP-2X master printing plate. Giving a detailed description of a method for forming the sample layer on the plate cylinder, the 200-μm film for thickness adjustment was first placed, overlaid with the 200-μm ELP-2X master printing plate etched, and a head portion of the plate was fastened with a clamp for fixing the plate cylinder. The block copy material sample for prevention of plate elongation having the same width as that of the plate and a length 4 cm shorter than that of the plate was inserted between the 200-μm film and the 200-μm ELP-2X master printing plate, and edge portions of the 200-μm film and the 200-μm ELP-2X master printing plate were fastened with a clamp. As ink and a fountain solution, materials standard in this system were used.

After printing of 2,000 sheets, the elongation of the plate from the start of printing was measured on printed coat paper. The measurement was made by observing the distance between two ruled lines drawn 30 cm apart as an image on the printing plate in a rotational direction of the plate cylinder, on printed matter at the start and after printing of 2,000 sheets. The difference therebetween was taken as the plate elongation.

If the projections due to the inorganic particles on the surface of the block copy material for prevention of plate elongation inserted between the 200-μm film and the 200-μm ELP-2X master are large in size and the large-sized projections is high in density, the image missing occurs on the two thousandth printed matter, resulting in unfitness for use from the viewpoint of quality as printed matter. From this, the degree of the image missing on the printed matter was visually evaluated. Results thereof are shown in Table 3.

TABLE 3

| Sample No. | Plate Elongation | Image Missing |
|---|---|---|
| 1 | ○ | x |
| 2 | ○ | x |
| 3 | ○ | Δ |
| 4 | ○ | Δ |
| 5 | ○ | Δ |
| 6 | ○ | Δ |
| 7 | ○ | ○ |
| 8 | ○ | ○ |
| 9 | ○ | ○ |
| 10 | ○ | ○ |
| 11 | ○ | ○ |
| 12 | ○ | ○ |
| 13 | Δ | ○ |
| 14 | Δ | ○ |
| 15 | x | ○ |
| 16 | x | ○ |

TABLE 3-continued

| Sample No. | Plate Elongation | Image Missing |
|---|---|---|

Evaluation Indication of Plate Elongation

| Indication | Plate Elongation |
|---|---|
| ○ | 0–0.4 mm |
| Δ | 0.5–1.0 mm |
| x | 1.1 mm or more |

Evaluation Indication of Image Missing

| Indication | Image Missing |
|---|---|
| ○ | Not observed at all |
| Δ | Slightly observed |
| x | Clearly observed |

As apparent from the above, when the projections on the surfaces of the block copy materials having a height of 3 μm or more was less than 25 projections/cm$^2$ in density, the effect of suppressing the strain (elongation) of the plate material was insufficient. On the other hand, when the projections having a height of 40 μm or more were increased to 20 projections/cm$^2$ or more in density, the image missing was remarkable. It was therefore confirmed that when the density of the projections having a specified height was within the range of the present invention, the strain (elongation) of the plate material could be well prevented while keeping the image good.

Example 2

A surface of a stainless steel plate cylinder plated with chromium was coated with a dispersion obtained by dispersing each of the following inorganic particles of five kinds in an amount shown Table 4 and an acrylic resin (manufactured by Fuji Photo Film Co., Ltd., Tg=37° C., a 40% toluene solution) as a binder in toluene with an EXCEL AUTO HOMOGENIZER (manufactured by Nippon Seiki Co., Ltd.) at 12,000 rpm for 15 minutes, by use of a wire bar so as to give a dry amount coated of 10 g/m$^2$, and then dried to obtain a sample of a plate cylinder. For coated surfaces of the series of samples, the height and density of projections were measured using a three-dimensional surface roughness tester (a measuring instrument Model SE-3F1, PU-DJ2U, and an analyzer Model SPA-11) manufactured by Kosaka Laboratory Ltd.

The following inorganic particles of five kinds were used:

FO #500, FO #1200, FO #3000, A #320 and A #240 (all manufactured by Fujimi Incorporated).

The composition and particle size at an accumulated height of 94% of the above-mentioned respective inorganic particles are shown in Table 5.

The formulation of the coating materials prepared and the density of projections on the resulting surfaces by height of the projections are shown in Table 4.

TABLE 4

| Sample No. | Formulation (g): Inorganic Particle | Amount Used | Resin Solution | Toluene | Density of Projections Having the Following Height (projections/cm$^2$): <3 μm | 3–5 μm | 5–15 μm | 15–40 μm | 40 μm< |
|---|---|---|---|---|---|---|---|---|---|
| 1 | A #240 | 20 | 5 | 10 | Unknown | Unknown | Unknown | 3410 | 54 |
| 2 | A #240 | 20 | 10 | 20 | Unknown | Unknown | Unknown | 1320 | 24 |
| 3 | A #240 | 6 | 20 | 30 | Unknown | Unknown | Unknown | 889 | 11 |
| 4 | A #320 | 20 | 5 | 10 | Unknown | Unknown | Unknown | 975 | 2 |
| 5 | A #320 | 12 | 10 | 20 | Unknown | Unknown | Unknown | 325 | 0 |
| 6 | A #320 | 6 | 20 | 30 | Unknown | Unknown | Unknown | 106 | 0 |
| 7 | FO #500 | 20 | 5 | 10 | Unknown | Unknown | 2310 | 73 | 0 |
| 8 | FO #500 | 12 | 10 | 20 | Unknown | Unknown | 870 | 24 | 0 |
| 9 | FO #500 | 6 | 20 | 30 | Unknown | Unknown | 392 | 11 | 0 |
| 10 | FO #1200 | 20 | 5 | 10 | ∞ | 1485 | 93 | 5 | 0 |
| 11 | FO #1200 | 12 | 10 | 20 | ∞ | 777 | 45 | 0 | 0 |
| 12 | FO #1200 | 6 | 20 | 30 | ∞ | 402 | 18 | 0 | 0 |
| 13 | FO #3000 | 20 | 5 | 10 | ∞ | 85 | 2 | 0 | 0 |
| 14 | FO #3000 | 12 | 10 | 20 | ∞ | 27 | 1 | 0 | 0 |
| 15 | FO #3000 | 6 | 20 | 30 | ∞ | 2 | 0 | 0 | 0 |
| 16 | Not coated | | | | None | | | | |

"Unknown" means that particles are concealed by larger particles to give no clear values, and "∞" means 5000 projections or more.

TABLE 5

| | Composition (% by weight): $Al_2O_3$ | $SiO_2$ | $Fe_2O_3$ | $TiO_2$ | $ZrO_2$ | Particle Size at An Accumulated Height of 94% |
|---|---|---|---|---|---|---|
| FO #500 | 47.5 | 18.5 | 0.4 | 1.4 | 37.5 | 12.5 |
| FO #1200 | 48.3 | 17.9 | 0.4 | 1.5 | 31.9 | 5.1 |
| FO #3000 | 43.2 | 20.3 | 0.5 | 1.5 | 34.5 | 1.8 |
| A #320 | 91.3 | 4.2 | 0.7 | 3.8 | — | 28.5 |
| A #240 | 91.8 | 4.4 | 0.6 | 3.2 | — | 47.5 |

The elongation of the printing plate in printing was measured using an Oliver 52 printing machine manufactured by Sakurai Kikai Hanbai Co., Ltd. under the standard printing conditions. As the printing plate, an ELP-2X master prepared with an ELP-580 platemaking machine manufactured by Fuji Photo Film Co., Ltd. was used. As ink and a fountain solution, materials standard in this system were used.

After printing of 2,000 sheets, the elongation of the plate from the start of printing was measured on printed coat paper. The measurement was made by observing the distance between two ruled lines drawn 30 cm apart as an image on the printing plate in a rotational direction of the plate cylinder, on printed matter at the start and after printing of 2,000 sheets. The difference therebetween was taken as the plate elongation.

If the projections due to the inorganic particles on the surface of the plate cylinder are large in size and the large-sized projections is high in density, the image missing occurs on the two thousandth printed matter, resulting in unfitness for use from the viewpoint of quality as printed matter. From this, the degree of the image missing on the printed matter was visually evaluated. Results thereof are shown in Table 6.

TABLE 6

| Sample No. | Plate Elongation | Image Missing |
|---|---|---|
| 1 | ○ | x |
| 2 | ○ | x |
| 3 | ○ | Δ |
| 4 | ○ | Δ |
| 5 | ○ | Δ |
| 6 | ○ | Δ |
| 7 | ○ | ○ |
| 8 | ○ | ○ |
| 9 | ○ | ○ |
| 10 | ○ | ○ |
| 11 | ○ | ○ |
| 12 | ○ | ○ |
| 13 | Δ | ○ |
| 14 | Δ | ○ |
| 15 | x | ○ |
| 16 | x | ○ |

Evaluation Indication of Plate Elongation

| Indication | Plate Elongation |
|---|---|
| ○ | 0–0.4 mm |
| Δ | 0.5–1.0 mm |
| x | 1.1 mm or more |

Evaluation Indication of Image Missing

| Indication | Image Missing |
|---|---|
| ○ | Not observed at all |
| Δ | Slightly observed |
| x | Clearly observed |

As apparent from the above, when the projections on the surfaces of the plate cylinders having a height of 3 μm or more was less than 25 projections/cm$^2$ in density, the effect of suppressing the strain (elongation) of the plate material was insufficient. On the other hand, when the projections having a height of 40 μm or more were increased to 20 projections/cm$^2$ or more in density, the image missing was remarkable. It was therefore confirmed that when the density of the projections having a specified height was within the range of the present invention, the strain (elongation) of the plate material could be well prevented while keeping the image good.

Example 3

A plate cylinder of an AM 1280 automatic printing machine manufactured by AM Co. was polished as uniformly as possible using an abrasive cloth roll [silicon carbide abrasive: GC, kind of grain size: P1000 (particle size at an accumulated height of 94%: 7.0 μm)]. After sufficient washing and drying, the surface roughness was measured in the same manner as with Example 1. The average surface roughness Ra after polishing was 27 μm, the density of projections having a height of more than 40 μm was 7 projections/cm$^2$ on average, and the density of projections having a height of more than 3 μm was 8910 projections/cm$^2$ on average. Before polishing, projections having a height of 3 μm or more was ones caused by flaws derived from impact, and the density thereof was 1.5 projections/cm$^2$ on average. The elongation of the plate at the time when printing was performed using this plate cylinder before and after polishing was measured in the same manner as with Example 1. As the printing plate, an ELP-2X master prepared with an ELP-330 RX platemaking machine manufactured by Fuji Photo Film Co., Ltd. was used. As ink and a fountain solution, materials standard in this system were used. After printing of 2,000 sheets, the elongation of the plate from the start of printing was measured on printed coat paper. The measurement was made by observing the distance between two ruled lines drawn 30 cm apart as an image on the printing plate in a rotational direction of the plate cylinder, on printed matter at the start and after printing of 2,000 sheets. The difference therebetween was taken as the plate elongation. The plate elongation before polishing was 1.4 mm, whereas that after polishing was 0.2 mm. No deterioration was observed in the printed image during printing, and it was confirmed that the elongation of the printing plate could be well prevented.

As described above, according to the present invention, the dimension stability and printing workability of the plate materials in the lithographic presses can be well improved while keeping the printed images good.

While the invention has been described in detail and with reference to specific embodiments thereof, it will be apparent to one skilled in the art that various changes and modifications can be made therein without departing from the spirit and scope thereof.

What is claimed is:

1. A block copy material for a lithographic printing plate material comprising a sheet-like substrate, on at least one side of which a plurality of minute projections are distributively formed, wherein the density of minute projections having a height of more than 40 μm is 20 projections/cm$^2$ or less on surface average, and the density of minute projections having a height of 3 μm or more is 25 projections/cm$^2$ or more on surface average.

2. The block copy material for a lithographic printing plate material according to claim 1, wherein the substrate has no minute projections having a height of more than 40 μm.

3. The block copy material for a lithographic printing plate material according to claim 1, wherein the density of minute projections having a height of 3 μm or more is 400 to 10,000 projections/cm$^2$ on surface average.

4. A lithographic printing method comprising carrying out printing by using a plate cylinder provided with the block copy material for a lithographic printing plate material according to claim 1 so that the side on which the minute projections are formed face toward the lithographic printing plate material side.

5. A lithographic press having a plate cylinder, wherein said plate cylinder has a surface on which a plurality of minute projections are formed, the density of projections having a height of more than 40 $\mu$m is 20 projections/cm$^2$ or less on surface average, and the density of minute projections having a height of 3 $\mu$m or more is 25 projections/cm$^2$ or more on surface average.

6. The lithographic press according to claim 5, wherein the plate cylinder has no minute projections having a height of more than 40 $\mu$m.

7. The lithographic press according to claim 5, wherein the density of minute projections having a height of 3 $\mu$m or more is 400 to 10,000 projections/cm$^2$ on surface average.

8. A lithographic printing method comprising carrying out printing by using the plate cylinder for lithography according to claim 5 around which a lithographic printing plate is wrapped.

* * * * *